US005634445A

United States Patent [19]

Nishioka et al.

[11] Patent Number: 5,634,445

[45] Date of Patent: Jun. 3, 1997

[54] AIR-FUEL RATIO CONTROL SYSTEM FOR ENGINE

[75] Inventors: Futoshi Nishioka, Hiroshima; Tetsushi Hosokai, Kure; Shinichi Mogaki, Aki-gun, all of Japan

[73] Assignees: Mazda Motor Corporation, Hiroshima; Mitsubishi Denki Kabushiki Kaisha, Tokyo, both of Japan

[21] Appl. No.: 499,994

[22] Filed: Jul. 10, 1995

[30] Foreign Application Priority Data

Jul. 11, 1994 [JP] Japan ..... 6-158743

[51] Int. Cl.[6] ..... F02B 31/00

[52] U.S. Cl. ..... 123/306; 123/308

[58] Field of Search ..... 123/306, 308, 123/184.56

[56] References Cited

U.S. PATENT DOCUMENTS 5,435,283 7/1995 Zehr ..... 123/306
5,474,044 12/1995 Matterazzo et al. ..... 123/306
5,551,393 9/1996 Amano et al. ..... 123/306
5,558,061 9/1996 Suminski ..... 123/306
5,575,248 11/1996 Tada ..... 123/184.56

FOREIGN PATENT DOCUMENTS 5-41822 6/1993 Japan ..... 123/306

*Primary Examiner*—Raymond A. Nelli

*Attorney, Agent, or Firm*—Sixbey, Friedman, Leedom & Ferguson, P.C.; Gerald J. Ferguson, Jr.

[57] ABSTRACT

An air-fuel control system for a lean burn engine which carries out lean burning under specific engine operating conditions causes the engine to burn at an stoichiometric air-fuel ratio regardless of engine operating conditions upon an occurrence of malfunctions of a stratifying device and/or a fuel injection timing control device, so as thereby to enable the engine always to operate in good conditions.

25 Claims, 10 Drawing Sheets

AIR-FUEL RATIO CONTROL SYSTEM FOR ENGINE

BACKGROUND OF THE INVENTION

1. Field of the invention

The resent invention relates to an air-fuel ratio control system for an internal combustion engine which causes burning a lean fuel mixture under specific engine operating conditions.

2. Description of Related Art

In order for internal combustion engines to yield improved fuel economy or fuel efficiency, it has been proved effective to produce a stratified fuel mixture in an combustion chamber and/or to accelerate atomization and evaporation of fuel by means of adjusting a timing of fuel injection so as to achieve, on one hand, improved combustibility of a fuel mixture and, on the other hand, combustion of a fuel mixture leaner than a "stoichiometric" air-fuel ratio, which is an engineering term for an ideally combustible air-fuel ratio, in a specific range of engine operating conditions. Further, in recent years, there have been proposed various closed loop or feedback air-fuel ratio control systems, for determining the oxygen content of exhaust and constantly monitoring the exhaust to verify the accuracy of a fuel mixture setting based on a deviation from a target air-fuel ratio according to a specific engine operating condition, which prohibit burning a lean fuel mixture and burns a fuel mixture at a stoichiometric air-fuel ratio when an air-fuel ratio sensor, such as an oxygen ($O_2$) sensor for detecting the oxygen content of exhaust. Such a feedback air-fuel ratio control system prevents aggravation of engine performance and deterioration in emission control.

In lean burn engines of this kind, if the lean burning lasts in spite of occurrences of troubles of a means for producing stratified fuel mixture in an combustion chamber and/or a means for adjusting a timing of fuel injection, the engine is continuously operated with a fuel mixture burned at lean air-fuel mixtures without increasing combustibility, which is always undesirable and leads to accidentally burning. For instance, in the case where a sensor is used to specify cylinders so as to adjust timing of fuel injection to the cylinders separately from one another so as to improve combustibility, malfunctions of the sensor disables the control of fuel injection at appropriate timing separately to the respective cylinders. If burning lasts at lean air-fuel ratios under such circumstances, the engine causes burning accidentally and is disabled to operate appropriately.

SUMMARY OF THE INVENTION

It is an object of the present invention to provide an air-fuel ratio control system for a lean burn engine which enables the engine to operate appropriately even upon occurrences of troubles or malfunctions of a means for producing a stratified fuel mixture in an combustion chamber and/or a means for adjusting a timing of fuel injection.

The above object of the present invention is achieved by providing an air-fuel ratio control system for an internal combustion engine, such as having a plurality of intake ports per cylinder, which is equipped with a stratifying means for producing a stratified fuel mixture in a combustion chamber of each cylinder and an air-fuel ratio control means for varying an air-fuel ratio toward the lean side during operation of the stratifying means. The control system includes a malfunction discernment means for discerning an occurrence of a malfunction of either or both of the stratifying means and an operation control means by which said stratifying means is controlled in operation, and a control restraint means for restraining the air-fuel ratio control means so as to interrupt variation of an air-fuel ratio toward the lean side and, for instance, to develop a stoichiometric air-fuel ratio.

Specifically, the stratifying means includes a cylinder discernment sensor for discerning a specific cylinder, an occurrence of a malfunction of which may be discerned by the malfunction discernment means, and a timing control means for controlling a timing of fuel injection into a cylinder in an intake stroke. For an engine of a type having a crankshaft creating four cycles at every turn, the malfunction discernment means may include a speed sensor for providing a plurality of rotational angle signals at every two turns of the crankshaft and discerns an occurrence of a malfunction of the cylinder discernment sensor according to a difference in number between the rotational angle signals and rotation signals provided by the cylinder discernment sensor provides one every two turns of the crankshaft.

The stratifying means comprises a swirl control means, such as a throttle valve for controlling an intake air flow disposed one of a plurality of intake port of each cylinder so as to control production of a swirl in the combustion chamber. In this instance, in association with the throttle valve, there are provided an electrically operated actuator for positioning the throttle valve according to positioning signals and a position sensor for providing position signals according to positions of the throttle valve. An occurrence of a malfunction of the position sensor is discerned by the malfunction discernment means according to a inconsistency between the positioning signal and position signal.

With the air-fuel control system of the present invention, upon an occurrence of a malfunction of the stratifying means or its associated sensor, an air-fuel ratio is restrained from varying toward the lean side and varied to a stoichiometric air-fuel ratio, it is prevented that lean burning continues regardless of a failure of producing a stratified fuel mixture in the combustion chamber. Fuel injection is timely made in an intake stroke of the cylinder related to the fuel injection, the stratification of a fuel mixture is effectively produced. In the case where a swirl control means, such as a throttle valve for controlling an intake air flow in the intake port, is utilized as the stratifying means, even upon an occurrence of a malfunction of the swirl control means or its associated sensor, an air-fuel ratio is restrained from varying toward the lean side and varied to a stoichiometric air-fuel ratio, prevented lean burning from continuing regardless of a failure of producing a stratified fuel mixture in the combustion chamber.

Further, upon an occurrence of a malfunction of a sensor which is in association with controlling a fuel injection timing to enable lean burning, the air-fuel ratio control is retrained so as to interrupt variation of an air-fuel ratio toward the lean side and to develop a stoichiometric air-fuel ratio, preventing lean burning from continuing regardless of a failure of producing a stratified fuel mixture in the combustion chamber and the engine from burning accidentally.

BRIEF DESCRIPTION OF THE DRAWINGS

The above and other objects and features of the present invention will be clearly understood from the following description with respect to a preferred embodiment thereof when considered in conjunction with the accompanying drawings, in which same reference numerals have been used to denote the same or similar elements or functions, and wherein.

DETAILED DESCRIPTION OF THE PREFERRED EMBODIMENTS

Figure 1:
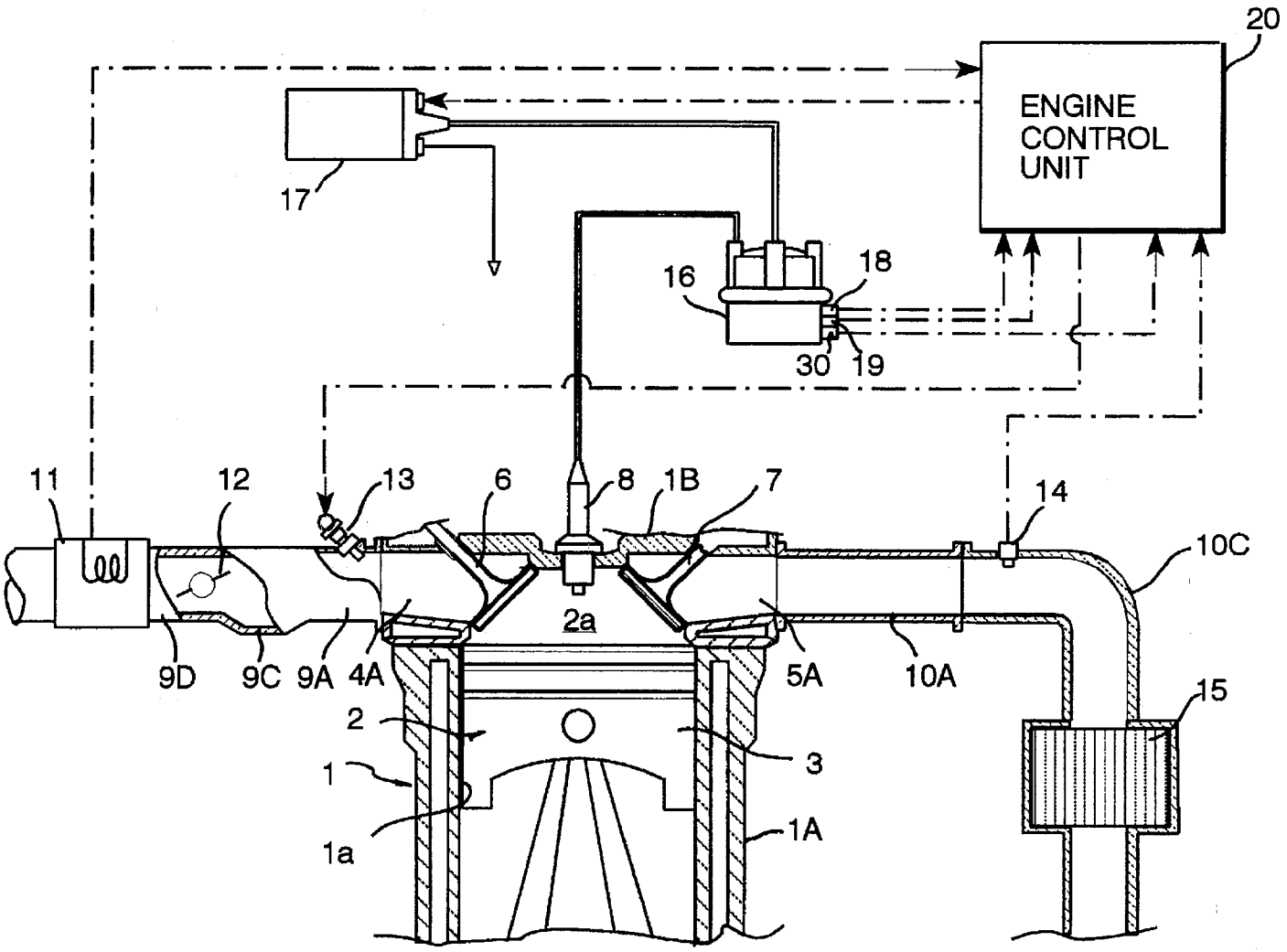
FIG. 1 is a schematic illustration showing an internal combustion engine equipped with an air-fuel ratio control system in accordance with a preferred embodiment of the present invention.
Figure 2:
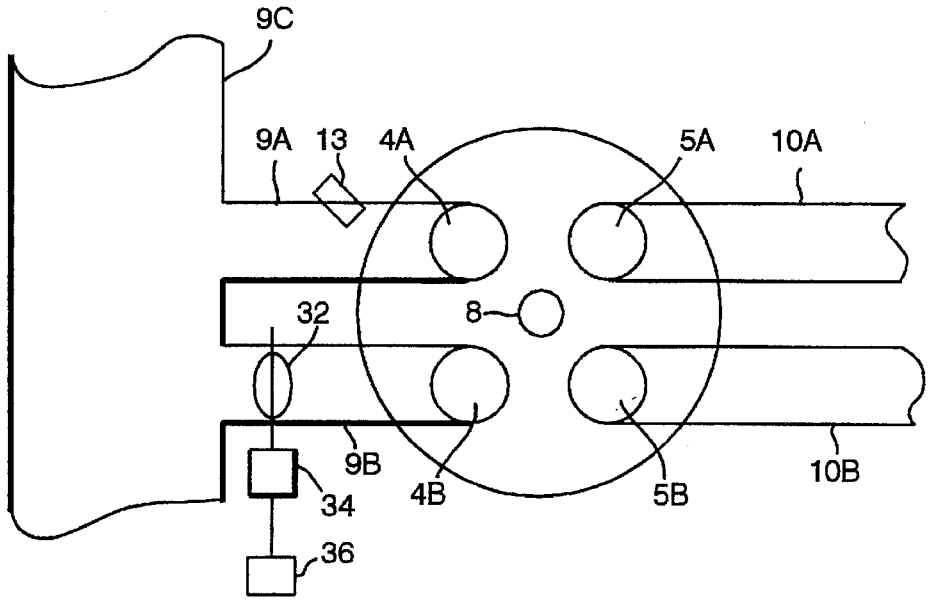
FIG. 2 is an enlarged schematic illustration showing a cylinder.

Referring now to the drawings in detail, and in particular, to FIGS. 1 and 2, an internal combustion engine 1, which in turn controlled by means of an air-fuel ratio control system in accordance with a preferred embodiment of the present invention, has a cylinder block 1A in which a plurality of cylinders 2 (only one of which is shown) are provided. A cylinder head 1B, shown partly, is mounted on the cylinder block 1A. A combustion chamber 2*a* is formed in the cylinder 2 by the top of a piston 3, a lower wall of the cylinder head 1B and the cylinder bore 1*a*. Each cylinder 2 is provided with two intake ports 4A and 4B and two exhaust port 5A and 5B which open into a combustion chamber 2*a* and are opened and shut at predetermined timing by intake valves 6 and exhaust valves 7, respectively. The cylinder head 1B is provided with a spark plug 8 whose electrodes protrude in the combustion chamber 2*a*.

Intake air is introduced into each cylinder 2 through individual intake pipes 9A and 9B provided with a fuel injection valve 13 via the intake ports 4A and 4B, respectively. The individual intake pipes 9A are in communication with a main intake pipe 9D through a serge tank 9C. Either one of the individual intake pipes 9A and 9B, for instance the individual intake pipe 9A which is referred to as a primary individual intake pipe in the embodiment, is provided with a fuel injection valve 13, and the other, i.e. the individual intake pipe 9B which is referred to as a secondary individual intake pipe, is provided with a throttle valve 32, serving as a swirl control means, for opening and closing the secondary individual intake pipe 9B so as to produce and control a swirl flow of fuel mixture in the combustion chamber 2*a*. There is a position sensor 36 provided in association with the swirl control throttle valve 32 to detect positions of the swirl control throttle valve 32. The main intake pipe 9D is provided in order from the upstream end with an air flow sensor 11 and a throttle valve 12. When the throttle valve 32 is actuated by an actuator 34 to close the secondary individual intake pipe 9B, intake air is introduced through the primary individual intake pipe 9A only, so as, on one hand, to expedite swirling of a flow of fuel mixture in the combustion chamber 2*a* and, on the other hand, to stratify fuel delivered in an intake stroke by the fuel injection valve 13, realizing lean burning of the fuel mixture, in other words, burning the fuel mixture at air-fuel ratios leaner than the stoichiometric air-fuel ratio. Various types of intake systems are well known to those skilled in the art and the intake system of the embodiment may take any known type.

Exhaust gas is discharged out from the cylinder 2 through two individual exhaust pipes 10A and 10B via the exhaust ports 5A and 5B. respectively. These individual exhaust pipes 10A and 10B are joined together to a main exhaust pipe 10C which is provided in order from the upstream end with a linear oxygen ($O_2$) sensor 14, functioning as an air fuel ratio sensor, and a catalytic converter 15, such as having a distinguished capability of purifying or eliminating oxides of nitrogen (NOx) in the exhaust for air-fuel ratios leaner than the stoichiometric air-fuel ratio. The linear oxygen ($O_2$) sensor 14 determines the oxygen content of exhaust which corresponds to an air-fuel ratio and provides an output signal changeable approximately linearly.

Figures 7A, 7B, 7C, 7D, 7E, 7F, 7G:
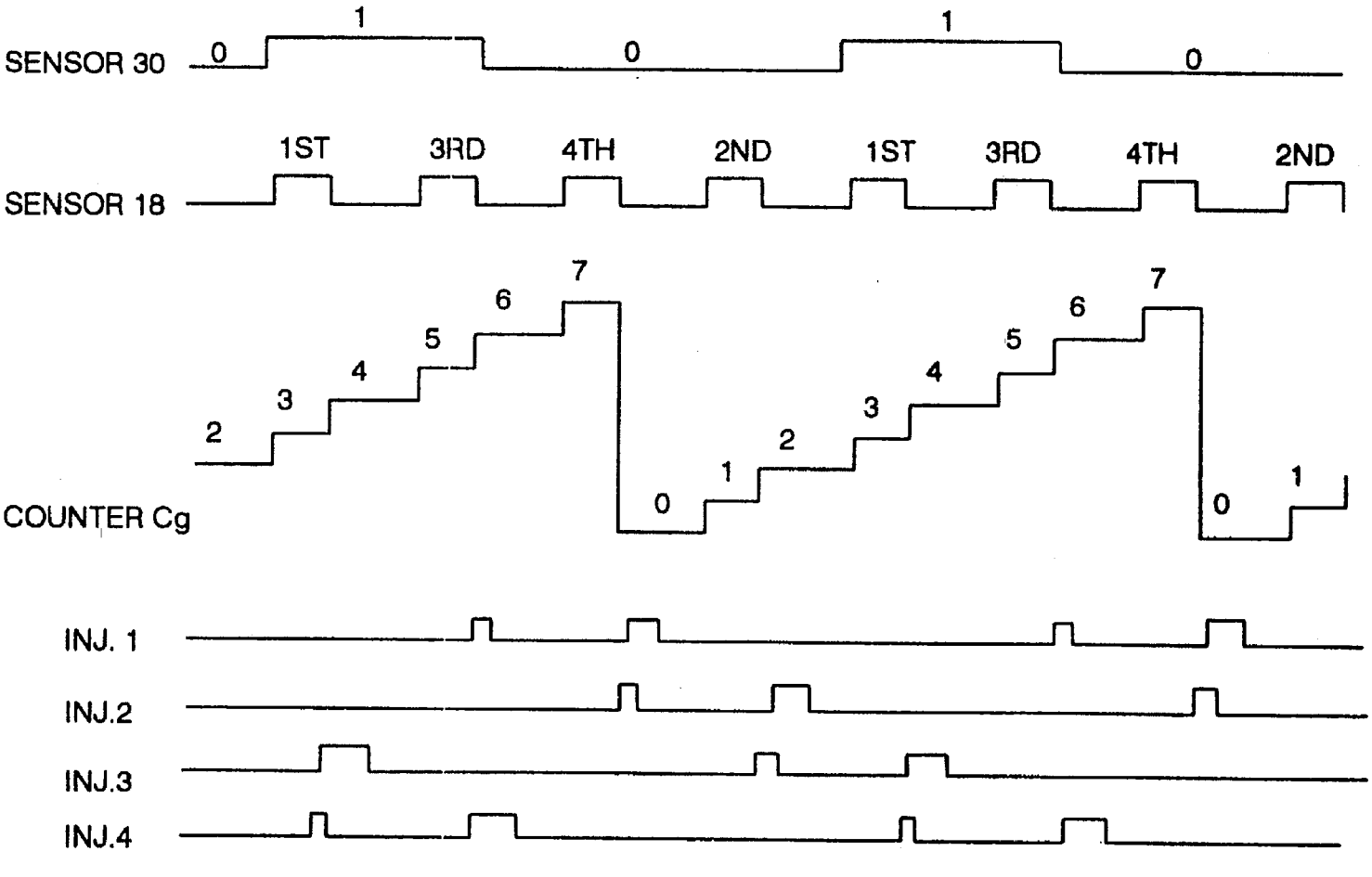
FIG. 7 is a time chart illustrating a relation between signals necessary for the determining the demanded amount of fuel to be delivered into a cylinder

For correct ignition timing, the cylinder 2 receives a spark at the plug electrodes of the spark plug 8 as the piston 3 nears the top (few degrees before TDC) of its combustion stroke. This is made by the proper hookup of the shaft of a distributor 16 to a crankshaft (not shown). High voltage leaving an ignition coil 17 is carded to the spark plug 8 at a correct timing provided by the distributor 16. The distributor 16 is provided with a crank angle sensor 18, an engine speed sensor 19 and a cylinder sensor 30. The crank angle sensor 18 provides signals at regular angles of rotation of the crankshaft. Specifically, the crank angle sensor 18 takes the form of a switch which turns on at a time a predetermined degree of crank angle before top dead center (TDC) of an intake stroke and provides a pulse signal and turns off near top dead center (TDC) of the intake stroke. In this instance, as shown in FIG. 7, the engine 1, for instance a four cylinder engine, has an arrangement of cylinders reaching top dead center of their intake strokes in order of 1st, 3rd, 4th and 2nd. The cylinder sensor 30 turns on at approximately the same timing as the crank angle sensor 18 turns on at top dead center (TDC) of an intake stroke of the 1st cylinder and turns off at approximately the same timing as the crank angle sensor 18 turns off after top dead center (TDC) of an intake stroke of the 3rd cylinder.

Figure 3:
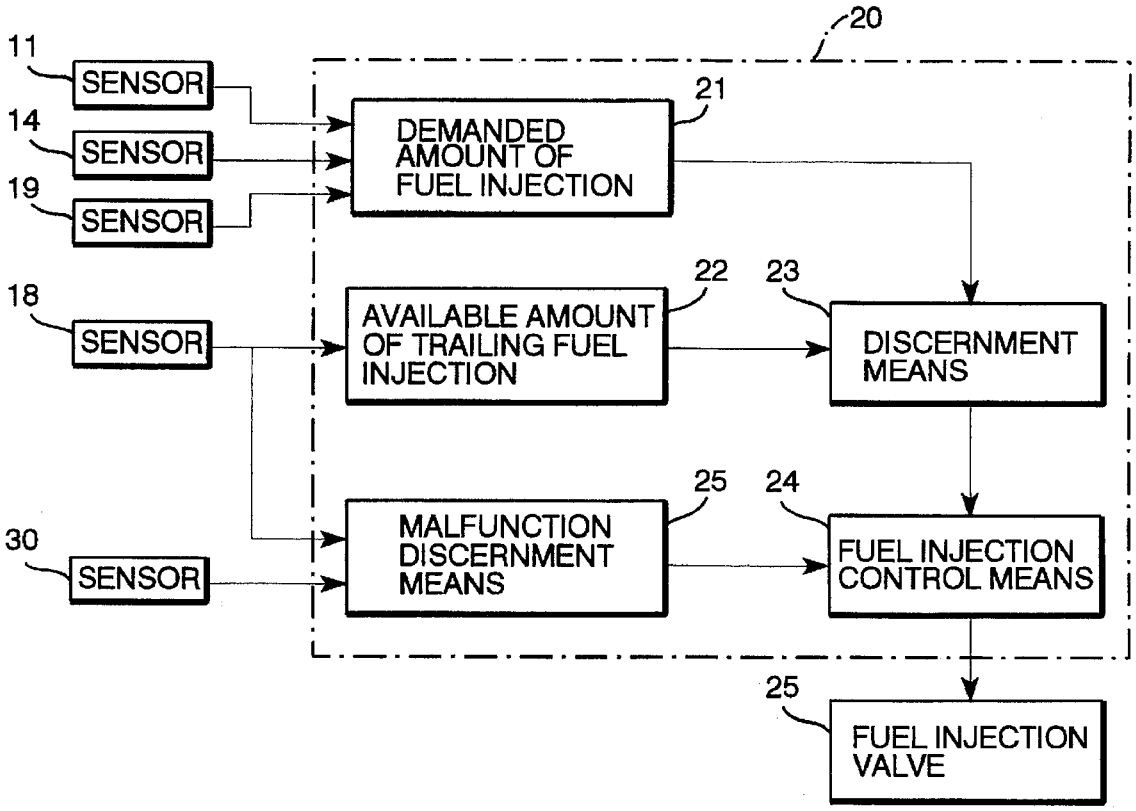
FIG. 3 is a functional block diagram of an engine control unit.

FIG. 3 shows in block an engine control unit (ECU) 20, mainly comprising a microcomputer, which receives signals from these sensors 11, 14 18, 19 and 30 and provides a pulse signal for pulsing the fuel injection valves 13. Pulsing an injector refers to energizing a solenoid causing the injector. Pulse width is a measurement of how long the injector is kept open—the wider the pulse width, the longer the open time. The amount of fuel delivered by a given injector depends upon the pulse width. The fuel injection valve 13 is timely caused at a correct timing of pulsing.

Describing more specifically, the engine control unit 20 includes various functional blocks 21–25. The engine control unit 20 includes calculation means 21 and 22, judging means 23 and 25 and a control means 24. The calculation means 21 performs a calculation of an amount of fuel injection demanded to provide an air-fuel ratio suitable for given conditions such as an amount of intake air detected by the air flow sensor 11 and an engine speed detected by the engine speed sensor 19. In this instance, only in an idling range of engine operating conditions, such as engine temperatures, engine speeds and engine loads less than specified values, respectively, the demanded amount of fuel injection is calculated so as to provide air-fuel ratios leaner than a stoichiometric air-fuel ratio. More specifically, the calculation means 21 calculates a basic amount of fuel injection on the basis of the amount of intake air and engine speed, and feedback controls the basic amount of fuel injection according to a result of comparison of a target air-fuel ratio obtained according to engine operating conditions with an effective air-fuel ratio detected by the linear oxygen sensor 14 so as thereby to determine the demanded amount of fuel injection. The calculation means 22 performs a calculation of an available amount of trailing fuel injection as will be described later. These calculations by the calculation means 21 and 22 are performed at a timing of the calculation of an amount of leading fuel injection. A determination as to which is larger between the demanded amount of fuel injection and the available amount of trailing fuel injection is made by the judging means 23.

The judging means 25 monitors signals from the crank angle sensor 18 and the cylinder sensor 30 and detects malfunctions of these sensors 18 and 30 in a manner described in detail later.

The control means 24 performs the control of fuel injection in two ways according to operational states of the sensors 18 and 30 as follows:

(1) In the case where the judging means 25 detects no malfunctions of the sensors 18 and 30, the control means 24 determines timings and amounts of leading and trailing fuel injection. In particular, if the demanded among of fuel injection is less than the available amount of trailing fuel injection, only the trailing fuel injection is performed at the determined timing, and, if the demanded among of fuel injection is greater than the available amount of trailing fuel injection, both leading and trailing fuel injection are performed at the determined timings, respectively. Accordingly, the demanded amount of fuel injection is obtained either by a single fuel injection or otherwise by two times of fuel injection so as to provide air-fuel ratios leaner than the stoichiometric air-fuel ratio. The timing of fuel injection for a specific fuel injection valve 13 is determined to be within an intake stroke of a cylinder related to the specific fuel injection valve 13.

(2) In the case where the judging means 25 detects malfunctions of either one or both of the sensors 18 and 30, the control means 24 determines an amount of fuel injection so as to always provide the stoichiometric air-fuel ratio. The fuel is delivered to the cylinders not separately but all at once at a predetermined timing.

Figure 4:
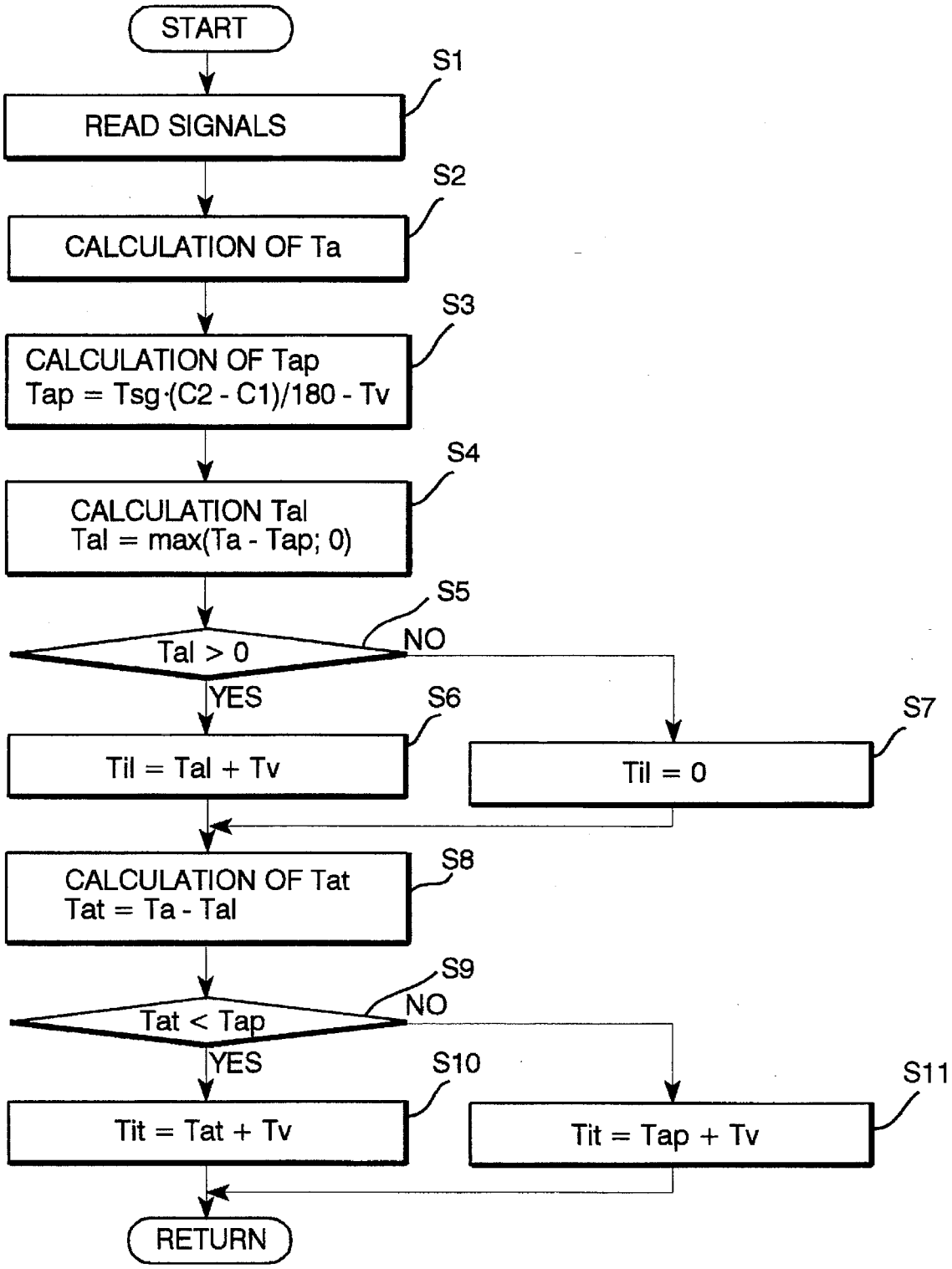
FIG. 4 is a flow chart illustrating a sequence routine of determining the demanded amount of fuel to be delivered into a cylinder.
Figure 6A:
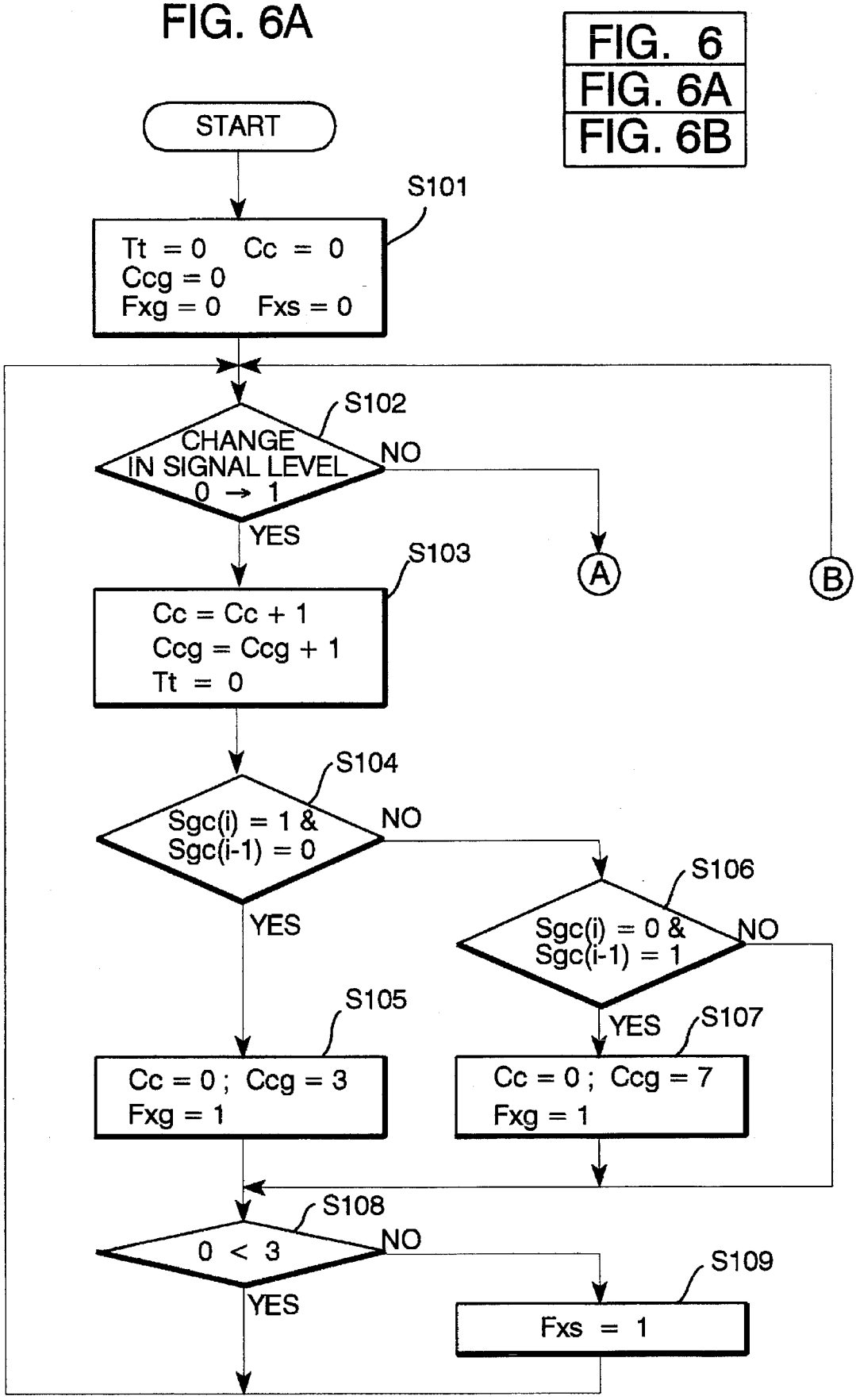
FIGS. 6 A and B are flow charts illustrating a sequence routine of discernment of an occurrence of a malfunction of a fuel injection control element and control of fuel injection timing.
Figure 8:
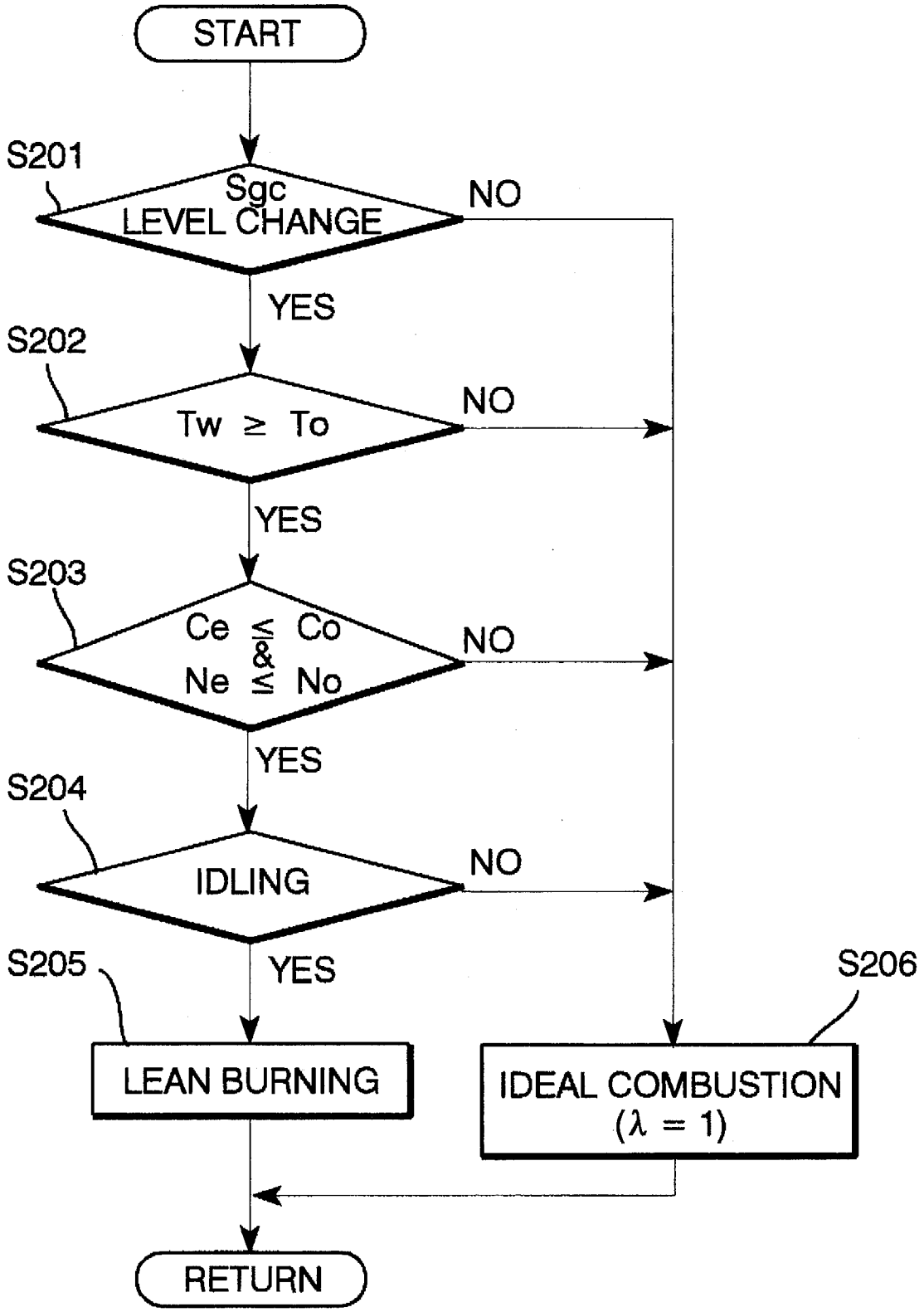
FIG. 8 is a flow chart illustrating a general sequence routine of control for the engine control unit.

The operation of the air-fuel control system depicted in FIGS. 1–3 is best understood by reviewing FIGS. 4, 6 and 8, which are flow charts illustrating various sequence routines for the microcomputer of the engine control unit 20. Programming a computer is a skill well understood in the art. The following description is written to enable a programmer having ordinary skill in the art to prepare an appropriate program for the microcomputer. The particular details of any such program would of course depend upon the architecture of the particular computer selected.

FIG. 4 is a flow chart of the sequence routine of determination of the amount of fuel injection. It is to be noted that the fuel injection is divided into two parts, namely leading fuel injection and trailing fuel injection. In the following description, various amounts of fuel injection are hereafter given as times for which the fuel injection valve is kept opened, i.e. the pulse width of a fuel injection pulse.

The sequence commences and control proceeds directly to step S1 where various signals are read. At step S2, a demanded amount of fuel Ta to be delivered by a given injector 13 is calculated based on engine operating conditions including at least the amount of intake air detected by the air flow sensor 11. This demanded amount of fuel injection Ta is established to be leaner than the stoichiometric air-fuel ratio in an idling range of engine operating conditions where engine coolant temperatures Tw, charging efficiencies Ce and engine speeds Ne are less than previously specified values To, Co and No, respectively, so that lean burning take place. Subsequently, an available amount of trailing fuel injection Tap and a demanded amount of leading fuel injection Tal are calculated at steps S3 and S4, respectively. Letting a crank angle of commencement of trailing fuel injection, the greatest allowable crank angle of termination of trailing fuel injection, a cycle of the periodical signal Tsg which is provided every 180° of turn of the crankshaft and an ineffective fuel injection time according to a buttery be C1, C2, Tsg and Tv, respectively, the available amount of trailing fuel injection Tap is given by the following equation:

$$Tap=Tsg(C2-C1)/180-Tv$$

For the demanded amount of leading fuel injection Tal, either one of the difference or deviation (Ta–Tap) of the demanded amount of fuel injection Ta from the available amount of trailing fuel injection Tap and 0 (zero), which is larger than the other, is adopted. In other words, if the demanded amount of fuel injection Ta is larger than the available amount of trailing fuel injection Tap, the difference (Ta–Tap) between them is substituted for the demanded amount of leading fuel injection Tal. On the other hand, if the demanded amount of fuel injection Ta is less than the available amount of trailing fuel injection Tap, the demanded amount of leading fuel injection Tal is let equal to zero (0). Thereafter, a decision is made at step S5 as to whether the demanded amount of leading fuel injection Tal is greater than zero (0). If the answer to the decision is "YES," then, at step S6, the pulse width Til of a leading injection pulse is determined to be the demanded amount of leading fuel injection Tal with the ineffective fuel injection time Tv added together. On the other hand, if the answer to the decision is "NO," this indicates that the demanded amount of fuel injection Ta is zero (0), then, the pulse width Til of a leading injection pulse is determined to be zero (0) at step S7. Subsequently, at step S8, a demanded amount of trailing fuel injection Tal is obtained by subtracting the demanded amount of leading fuel injection Tal from the demanded amount of fuel injection Ta. Consequently, if the demanded amount of fuel injection Ta is less than the available amount of trailing fuel injection Tap, in other words, if the pulse width Til of an injection pulse is zero (0), the demanded amount of fuel injection Ta is taken as the demanded amount of trailing fuel injection Tal. On the other hand, if the demanded amount of fuel injection Ta is greater than the available amount of trailing fuel injection Tap, the available amount of trailing fuel injection Tap is adopted as the demanded amount of trailing fuel injection Tal.

At step S9, another decision is made as to whether the demanded amount of trailing fuel injection Tal is less than the available amount of trailing fuel injection Tap. If the answer to the decision is "YES," then, at step S10, the pulse width Tit of a trailing injection pulse is determined to be the demanded amount of trailing fuel injection Tal with the ineffective fuel injection time Tv added together. On the other hand, if the answer to the decision is "NO," this indicates that the demanded amount of trailing fuel injection Tal is greater than the available amount of trailing fuel injection Tap, then, at step S11, the pulse width Tit of a trailing injection pulse is determined to be the available amount of trailing fuel injection Tap with the ineffective fuel injection time Tv added together. After the determination of the pulse width of a trailing fuel injection Tit either at step S10 or at step S11, the final step orders return.

Figure 5:
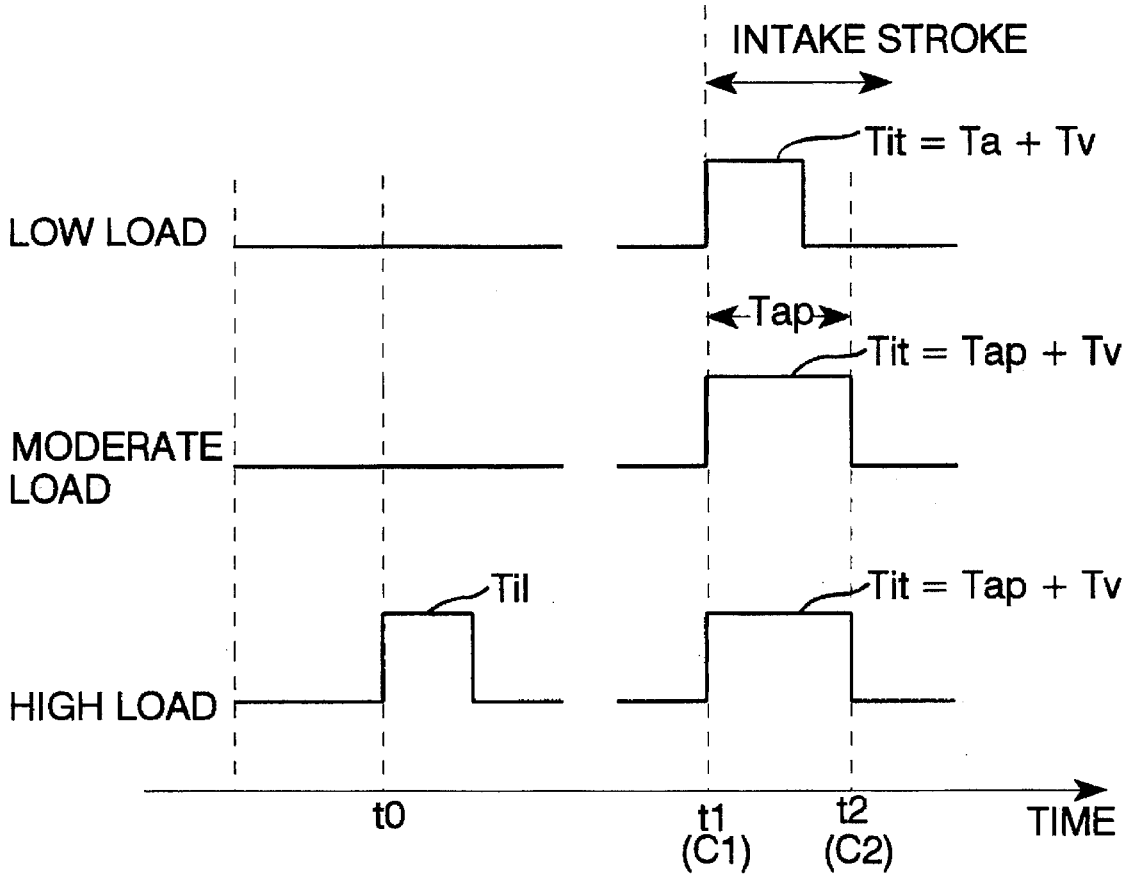
FIG. 5 is a time chart illustrating the determination of amount of fuel in a sequential fuel injection.

The operation described above is shown in a time chart in FIG. 5. A time t0 at which leading fuel injection commences is set to a point appropriately before an intake stroke. A time t1 or a crank angle C1 at which trailing fuel injection commences is set to a point desirable for causing burning of a stratified fuel mixture, for instance at top dead center (TDC) of an intake stroke. A time t2 or a crank angle C2 is the permissible latest time or the permissible greatest crank angle for trailing fuel injection and if trailing fuel injection terminates after the time t2, there occurs some difficulty in fuel injection to the combustion chamber 2*a*.

In the sequence routine, at the moment of or immediately before the commencement of leading fuel injection at the time t0, a comparison is made between the demanded amount of fuel injection Ta and the available amount of trailing fuel injection Tap is found. In a range of low engine loads where the demanded amount of fuel injection Ta is less than the available amount of trailing amount of fuel injection Tap and in a range of moderate engine loads where the demanded amount of fuel injection Ta is substantially equal to the available amount of trailing fuel injection Tap, the demanded among of leading fuel injection Tal takes zero (0), i.e. the pulse width of a leading fuel injection pulse is set zero (0), and the pulse width Tit of a trailing fuel injection pulse is equal to the sum of the demanded amount of fuel injection Ta and the ineffective fuel injection time Tv, so that the demanded amount of fuel injection Ta is covered by trailing fuel injection only. Accordingly, in the low and moderate engine load ranges, only trailing fuel injection always takes place. This yields the alleviation of dispersion of fuel and improves the stratification of fuel. Together, in these ranges, the demanded amount of fuel injection Ta is determined so as to shift an air-fuel ratio toward the lean side, realizing lean burning of a stratified fuel mixture and improving fuel economy or fuel efficiency. On the other hand, in a range of high engine loads where the demanded amount of fuel injection Ta is greater than the available amount of trailing fuel injection Tap, leading fuel injection bears only a part of the demanded amount of fuel injection Ta exceeding the available amount of trailing fuel injection Tap. Accordingly, even in the high engine load range where divided fuel injection take place, it is not necessary to make a calculation of proportions of the demanded amount of fuel injection which leading and trailing fuel injection bear which is always intricate, simplifying the control of air-fuel ratio.

FIG. 6 is a flow chart of the sequence routine of cylinder sensor malfunction discernment and fuel injection timing observation. In the sequence routine, there are used a cylinder discernment flag Fxg which is up or set to a state of "1" when the cylinder is continually discerned and a cylinder sensor malfunction discernment flag Fxs which is up or set to a state of "1" when some malfunctions of the cylinder sensor 30 are discerned. It will be recalled from the above description that the crank angle sensor 18 provides crank angle signals at a level of "1" at regular angles of rotation of the crankshaft and the cylinder sensor 30 provides a signal at a level of "1" when it turns on at approximately the same timing as the crank angle sensor 18 turns on at top dead center (TDC) of an intake stroke of the 1st cylinder and removes the signal when it turns off at approximately the same timing as the crank angle sensor 18 turns off after top dead center (TDC) of an intake stroke of the 3rd cylinder.

The sequence commences and control proceeds directly to step S101 where initialization is made. In the initialized state, a timer and counters are reset and flags are down or reset to a state of "0." At step S102, a decision is made as to whether there is a change in level of the signal from the cylinder sensor 30 from a level "0" to a level "1." If the answer to the decision is "YES," this indicates that the 1st cylinder is detected, then, a cylinder sensor malfunction discernment counter and a fuel injection timing observation counter change their counts Cc and Cg by an increment of 1 (one), respectively, and the engine stall discernment timer resets its count Tc to zero (0). Subsequently, a decision is made at step S104 as to whether there is a change in level of the signal Sgc from the cylinder sensor 30 from the level of "0" in the preceding sequence (i-1) to the level of "1" in the current sequence (i). If the answer to the decision is "YES," this indicates that the cylinder sensor 30 discerns the 1st cylinder, then, the cylinder sensor malfunction discernment counter and the fuel injection timing observation counter change their counts Cc and Cg to zero (0) and three (3), respectively, and simultaneously, the cylinder discernment flag Fxg is set to the state of "1" at step S105. On the other hand, if the answer to the decision is "NO," then, another decision is made at step S106 as to whether there is a change in level of the signal Sgc from the cylinder sensor 30 from the level of "1" in the preceding sequence (i-1) to the level of "0" in the current sequence (i). If the answer to the decision is "YES," this indicates that the cylinder sensor 30 discerns the 3rd cylinder, then, the cylinder sensor malfunction discernment counter and the fuel injection timing observation counter change their counts Cc and Cg to zero (0) and seven (7), respectively, and simultaneously, the cylinder discernment flag Fxg is set to the state of "1" at step S107. As apparent from the decisions made at step S104 and S106, the cylinder sensor malfunction discernment counter reset its count Cc to zero (0) every time the cylinder sensor 30 changes its signal level from "1" to "0" or vise versa.

After having changed the states of counters and flag either at step S105 or S107 or if the answer to the decision made at step S107 is "NO," a decision is made at step S108 as to whether the cylinder sensor malfunction discernment counter has a count Cc of three (3). The fact that the cylinder sensor 30 does not change its signal level although there has been provided more-than-three crank angle signals gives the ground of judgement that the cylinder sensor 30 has broken down. If the answer to the decision is "YES" or after setting the cylinder sensor malfunction discernment flag Fxs up at step S109 if the answer to the decision is "NO," the sequence routine is repeated from the decision concerning a change in level of a cylinder sensor signal at step S102.

Figure 6B:
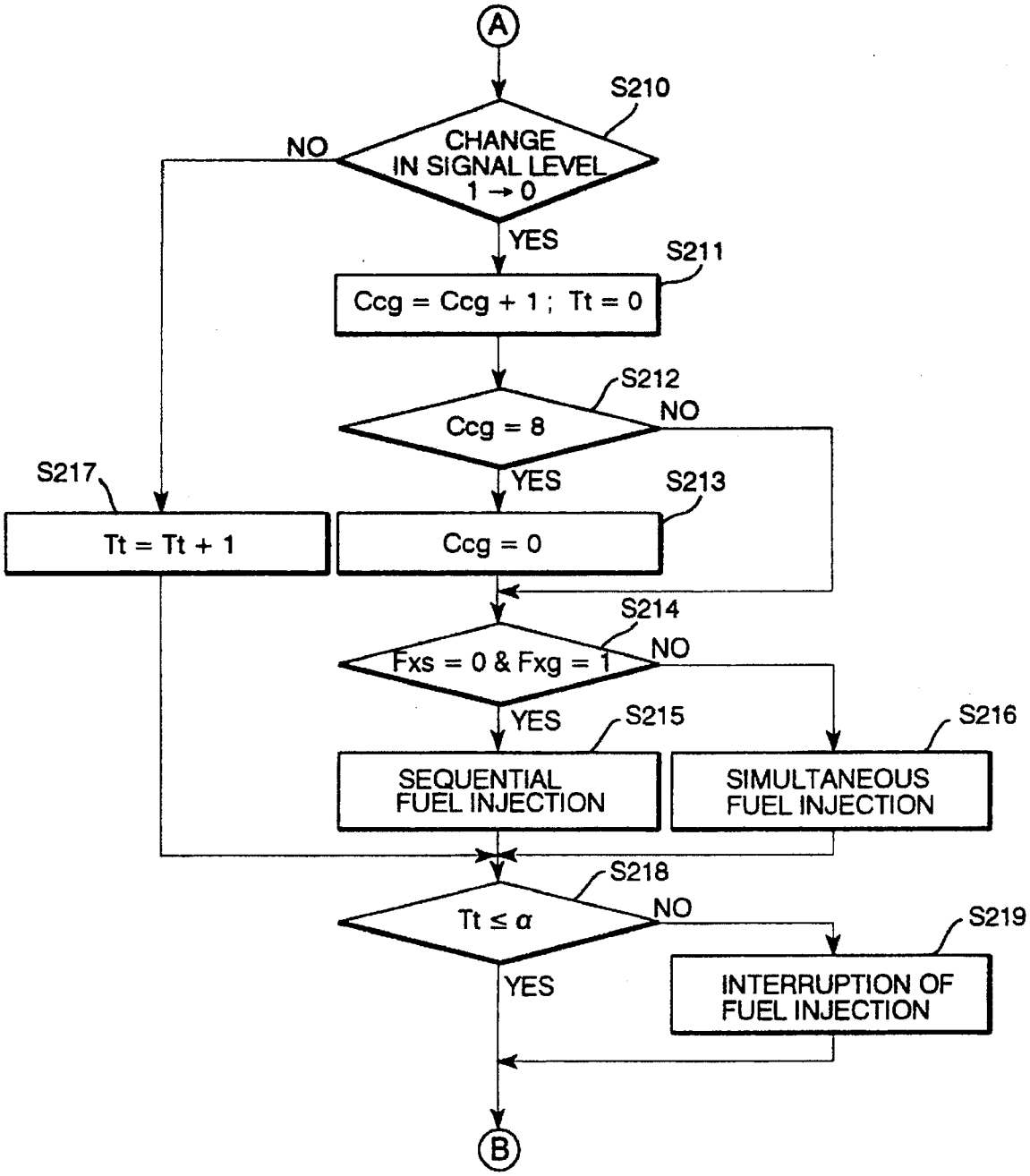

On the other hand, if the answer to the decision concerning a change in level of a cylinder sensor signal at step S102 is "NO," another decision is made at step S110 in FIG. 6B as to whether there is a change in level of the crank angle signal from the crank angle sensor 18 from the level "1" to the level "0." If the answer to the decision is "YES," the fuel injection timing observation counter changes its count Cg by an increment of one (0) and the engine stall discernment timer resets its count discernment timer resets its count Tc to zero (0) at step S111. Subsequently, a decision is made at step S112 as to whether the fuel injection timing observation counter has counted a count Cg of eight (8). This decision is made in for the fuel injection timing observation counter order to repeat a count limited to seven (7). If the answer to the decision is "NO" or after having changed the fuel injection timing observation counter to a count Cg of zero (0) at step S113 if the answer to the decision is "YES," another decision is made at step S114 as to whether the cylinder sensor malfunction discernment flag Fxs and the cylinder discernment flag Fxg have been set up and down, respectively. If the answer to the decision is "YES," this indicates that the discernment of cylinder is continually made and there is no occurrence of malfunctions of the cylinder sensor 30, sequential fuel injection control in which the timing of fuel injection is controlled for every cylinder is performed at step S115.

As shown in FIG. 7, in the sequential fuel injection control, the fuel injection timing observation counter indicates by its count Cg a specific cylinder which is in an intake stroke. Specifically, it is clearly distinctive that the 1st, 2nd, 3rd and 4th cylinders in their intake strokes are indicated by the counts Cg of 2, 0,4 and 6, respectively. In order of the number of count Cg, the fuel injection valves 13 related the respective cylinders are activated according to the pulse widths Til and Tit obtained through the sequence routine of determination of the amount of fuel injection in FIG. 4.

If the answer to the decision concerning flags Fxs and Fxg is "NO," i.e. if the cylinder sensor malfunction discernment flag Fxs has been up, which indicates that the cylinder sensor 30 has broken down or if the cylinder discernment flag Fxg has been down, which indicates that the cylinder sensor 30 is at an early stage immediately after actuation, fuel injection is made for the cylinders all at once at step S116. In such a case, lean burning is not carded out regardless of engine operating conditions and the pulse width Ti is calculated from the following equation so as to provide the stoichiometric air-fuel ratio.

$$Ti=Ta/4+Tv$$

After changing the count Tc of the engine stall discernment timer by an increment of 1 (one) at step S117 when the answer to the decision regarding a change of the crank angle signal from the level "1" to the level "0" made at step S110 is "NO" or subsequent to fuel injection at step S115 or Step S116, another decision is made at step S118 as to whether the engine stall discernment timer has counted a predetermined critical time $\alpha$. If the answer to the decision is "NO," this indicates that there is no change in level of the crank angle signal for more than the critical time $\alpha$, which gives the ground of judgement of an occurrence of engine stall, then, at step S119, fuel injection is interrupted. If the answer to the decision made at step S118 is "YES," or after the interruption of fuel injection at step S119, the sequence routine is repeated from the decision concerning a change in level of a cylinder sensor signal at step S102.

Referring to FIG. 8, which is a flow chart of the general sequence routine of control for the engine control unit 20, the general sequence routine commences and various decisions are consecutively made as to whether there does not occur any malfunction of the cylinder sensor 30, i.e. there is a change in level of the signal Sgc from the cylinder sensor 30, at step S201, whether the temperature of engine coolant Tw is above the specified temperature To at step S203, whether a decision is made at step S202 as to whether the charging efficiency Ce and the engine speed Ne are less than the specified values Co and No, respectively at step S203, and whether the engine is not idling at step S204. If the answers to all of these decisions are "YES," the sequential fuel injection is carded out at step S205 so as to enable lean burning. However, if the answer to any one of the decisions is "NO," combustion is made at the stoichiometric air-fuel ratio (which is represented by an excessive air ratio $\lambda=1$) at step S206.

In the air-fuel control system, it may be done to discern malfunctions not of the cylinder sensor 30 but of the swirl control throttle valve 32.

Figure 9:
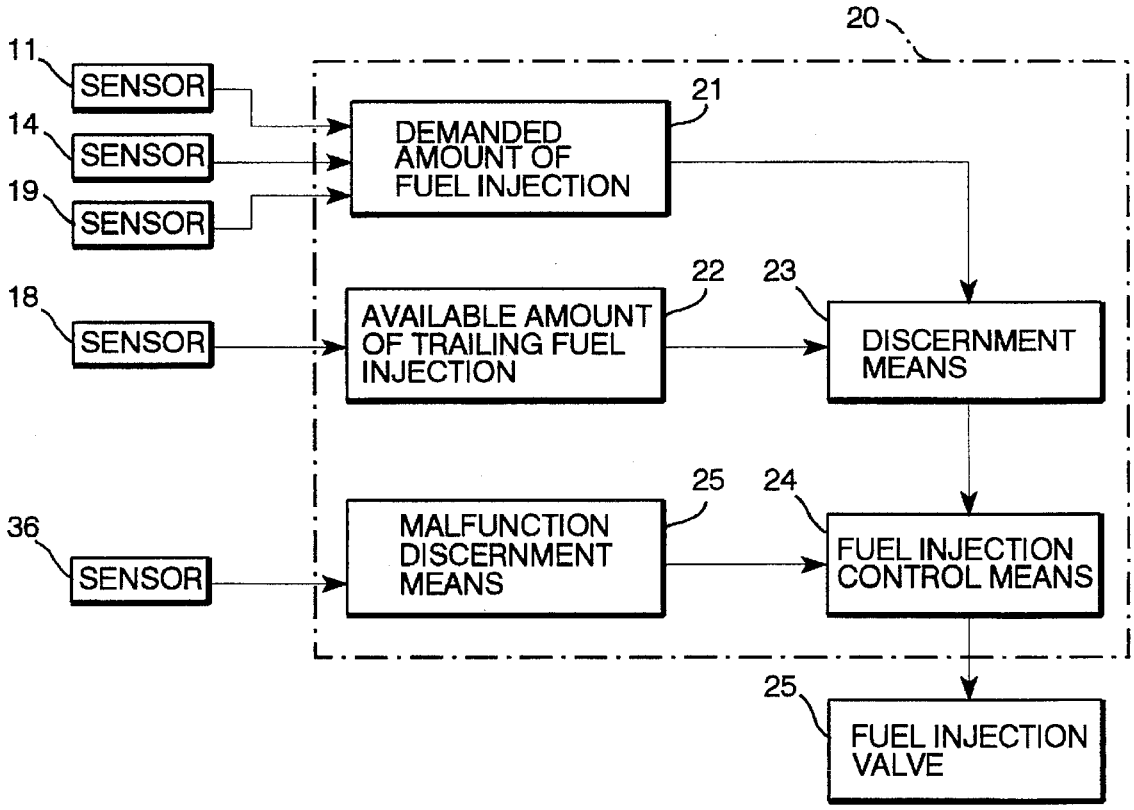
FIG. 9 is a functional block diagram of an engine control unit for performing the control of an air-fuel ratio in accordance with another preferred embodiment of the present invention.
Figure 10:
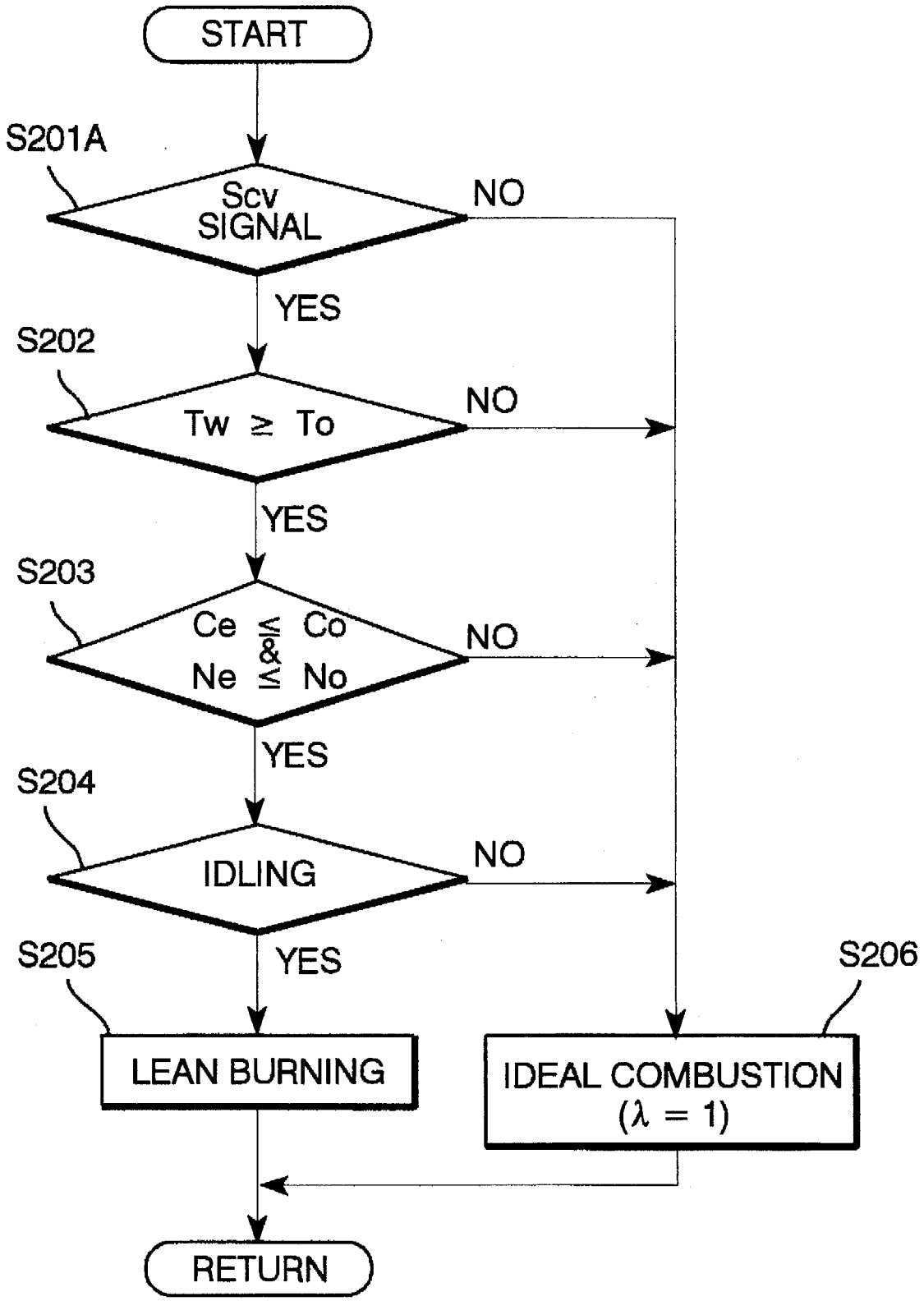
FIG. 10 is a flow chart illustrating a general sequence routine of control for the engine control unit shown in FIG. 9.

FIGS. 9 and 10 show an air-fuel ratio control system which interrupts or suspends lean burning whenever there occurs any malfunctions of the position sensor 36 for the swirl control throttle valve which functions to produce and control a stratified fuel mixture in the combustion engine 2*a*. The general sequence routine of control in FIG. 10 is similar to that in FIG. 8, excepting that the first decision is simply changed to malfunctions of the position sensor 36, i.e. there is provided a signal Scv from the position sensor 36, at step S201A from malfunctions of the cylinder sensor 32 at step S201. Together, as apparent from FIG. 9, the decision of malfunctions of the position sensor 36 does not need information concerning the crank angle sensor 18.

In this instance, the judgement that the position sensor 36 has broken down is made on the ground of the fact that the position sensor 36 does not provide any position signal indicative of positions of the swirl control throttle valve 32 in spite of command signals given to the actuator 34.

As apparent from the description, when the stratification of a fuel mixture is rendered difficult due to some malfunctions of the cylinder sensor 30 or the position sensor 36 to be produced in the combustion chamber 2*a* by means of the sequential fuel injection, lean burning is always interrupted, so as to prevent certainly the engine from burning accidentally.

Although the air-fuel ratio control system of the present invention has been described with regard to preferred embodiments in which fuel injection is carried out during an intake stroke of each cylinder with the intention of producing a stratified fuel mixture, nevertheless, it may be realized in internal combustion engines which fuel injection is made before an intake stroke of each cylinder so as to accelerate atomization and evaporation of fuel, thereby carrying out lean burning. In such a case, lean burning may be interrupted upon an occurrence of a malfunction of the cylinder sensor 30 used to adjust a fuel injection timing. Further, in case of the interruption of lean burning, combustion may be not always forced at the stoichiometric air-fuel ratio over the entire range of engine operating conditions. Alternatively, the air-fuel ratio may be learner than the stoichiometric air-fuel ratio unless accidental burning occurs.

The basic amount of fuel injection may not be calculated on the basis of engine temperature and engine loads but established so as to permit lean burning to take place for low speed driving and cause burning at the stoichiometric air-fuel ratio for high speed driving.

It is further to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. An air-fuel ratio control system for a multi-cylinder, internal combustion engine equipped with stratifying means for producing a stratified fuel mixture in a combustion chamber of each of cylinders and air-fuel ratio control means for varying an air-fuel ratio toward the lean side during operation of the stratifying means, said air fuel control system comprising:

operation control means for controlling said operation of said stratifying means;

malfunction discernment means for discerning an occurrence of a malfunction of at least one of said operation control means and said stratifying means; and control restraint means for restraining said air-fuel ratio control means from varying an air-fuel ratio toward the lean side.

2. An air-fuel control system as defined in claim 1, wherein said stratifying means includes a cylinder discernment sensor for discerning a specific cylinder based on a rotational angle of an engine crankshaft and a timing control means for controlling a timing at which fuel is delivered into each said cylinder in an intake stroke.

3. An air-fuel control system as defined in claim 2, wherein said control restraint means forces an air-fuel ratio toward a stoichiometric air-fuel ratio.

4. An air-fuel control system as defined in claim 3, and further comprising sensor means for providing rotation signals one at every two turns of said engine crankshaft which creates four cycles at every turn and discerning said specific cylinder so as to control operation of said timing control means to adjust a desired timing at which fuel is delivered into said specific cylinder in an intake stroke during operation of said air-fuel ratio control means, wherein said malfunction discernment means includes a speed sensor for providing a plurality of rotational angle signals at every two turns of said engine crankshaft and discerns an occurrence of a malfunction of said sensor means according to a difference in number between said rotation signals and said rotational angle signals.

5. An air-fuel control system as defined in claim 2, wherein said malfunction discernment means discerns an occurrence of a malfunction of said discernment sensor.

6. An air-fuel control system as defined in claim 5, wherein said control restraint means forces an air-fuel ratio toward a stoichiometric air-fuel ratio.

7. An air-fuel control system as defined in claim 6, and further comprising sensor means for providing rotation signals one at every two turns of said engine crankshaft which creates four cycles at every turn and discerning said specific cylinder so as to control operation of said timing control means to adjust a desired timing at which fuel is delivered into said specific cylinder in an intake stroke during operation of said air-fuel ratio control means, wherein said malfunction discernment means includes a speed sensor for providing a plurality of rotational angle signals at every two turns of said engine crankshaft and discerns an occurrence of a malfunction of said sensor means according to a difference in number between said rotation signals and said rotational angle signals.

8. An air-fuel control system as defined in claim 3, wherein said engine is of a type having a crankshaft creating four cycles at every turn and said cylinder discernment sensor provides rotation signals one at every two turns of said crankshaft.

9. An air-fuel control system as defined in claim 8, wherein said control restraint means forces an air-fuel ratio toward a stoichiometric air-fuel ratio.

10. An air-fuel control system as defined in claim 9, and further comprising sensor means for providing rotation signals one at every two tuns of said engine crankshaft which creates four cycles at every turn and discerning said specific cylinder so as to control operation of said timing control means to adjust a desired timing at which fuel is delivered into said specific cylinder in an intake stroke during operation of said air-fuel ratio control means, wherein said malfunction discernment means includes a speed sensor for providing a plurality of rotational angle signals at every two turns of said engine crankshaft and discerns an occurrence of a malfunction of said sensor means according to a difference in number between said rotation signals and said rotational angle signals.

11. An air-fuel control system as defined in claim 4, wherein said malfunction discernment means includes a speed sensor for providing a plurality of rotational angle signals at every two turns of said crankshaft and discerns an occurrence of a malfunction of said cylinder discernment sensor according to a difference in number between said rotation signals and said rotational angle signals.

12. An air-fuel control system as defined in claim 11, wherein said control restraint means forces an air-fuel ratio toward a stoichiometric air-fuel ratio.

13. An air-fuel control system as defined in claim 12, and further comprising sensor means for providing rotation signals one at every two turns of said engine crankshaft which creates four cycles at every tun and discerning said specific cylinder so as to control operation of said timing control means to adjust a desired timing at which fuel is delivered into said specific cylinder in an intake stroke during operation of said air-fuel ratio control means, wherein said malfunction discernment means includes a speed sensor for providing a plurality of rotational angle signals at every two turns of said engine crankshaft and discerns an occurrence of a malfunction of said sensor means according to a difference in number between said rotation signals and said rotational angle signals.

14. An air-fuel control system as defined in claim 1, wherein said stratifying means comprises swirl control means for controlling production of a swirl in said combustion chamber.

15. An air-fuel control system as defined in claim 14, wherein said control restraint means forces an air-fuel ratio toward a stoichiometric air-fuel ratio.

16. An air-fuel control system as defined in claim 15, and further comprising sensor means for providing rotation signals one at every two turns of said engine crankshaft which creates four cycles at every turn and discerning said specific cylinder so as to control operation of said timing control means to adjust a desired timing at which fuel is delivered into said specific cylinder in an intake stroke during operation of said air-fuel ratio control means, wherein said malfunction discernment means includes a speed sensor for providing a plurality of rotational angle signals at every two turns of said engine crankshaft and discerns an occurrence of a malfunction of said sensor means according to a difference in number between said rotation signals and said rotational angle signals.

17. An air-fuel control system as defined in claim 14, wherein said engine is of a type having a plurality of intake ports for each said cylinder, in association with one of which said swirl control means is provided.

18. An air-fuel control system as defined in claim 1, wherein said swirl control means includes a control valve for controlling an intake air flow into said combustion chamber through said one intake port.

19. An air-fuel control system as defined in claim 18, wherein said swirl control means further includes an electrically operated actuator for positioning said control valve according to positioning signals and a position sensor for providing position signals according to positions of said control valve, and said malfunction discernment means discerns an occurrence of a malfunction of said position sensor according to a positional inconsistency between said positioning signal and said position signal.

20. An air-fuel control system as defined in claim 19, wherein said control restraint means forces an air-fuel ratio toward a stoichiometric air-fuel ratio.

21. An air-fuel ratio control system for a multi-cylinder, internal combustion engine equipped with air-fuel ratio control means for varying an air-fuel ratio toward the lean side and timing control means for adjusting a desired timing at which fuel is delivered into each said cylinder in an intake stroke during operation of said air-fuel ratio control means, said air-fuel control system comprising:

a sensor for controlling adjustment operation of said timing control means;

malfunction discernment means for discerning an occurrence of a malfunction of said sensor; and control restraint means for restraining said air-fuel ratio control means from varying an air-fuel ratio toward the lean side.

22. An air-fuel control system as defined in claim 21, wherein said engine is of a type having a crankshaft creating four cycles at every turn and said sensor provides rotation signals one at every two turns of said crankshaft.

23. An air-fuel control system as defined in claim 22, wherein said control restraint means forces an air-fuel ratio toward a stoichiometric air-fuel ratio.

24. An air-fuel control system as defined in claim 22, wherein said malfunction discernment means includes a speed sensor for providing a plurality of rotational angle signals at every two turns of said crankshaft and discerns an occurrence of a malfunction of said sensor according to a difference in number between said rotation signals and said rotational angle signals.

25. An air-fuel control system as defined in claim 24, wherein said control restraint means forces an air-fuel ratio toward a stoichiometric air-fuel ratio.

* * * * *